United States Patent [19]

Visser et al.

[11] Patent Number: 4,732,191

[45] Date of Patent: Mar. 22, 1988

[54] THERMAL PUMPING SYSTEM FOR LIQUID PRODUCTS

[75] Inventors: Adam P. Visser, Veldhoven; Jan Blom, Wijk bij Duurstede, both of Netherlands

[73] Assignee: Lever Brothers Company, New York, N.Y.

[21] Appl. No.: 791,251

[22] Filed: Oct. 25, 1985

[30] Foreign Application Priority Data

Oct. 29, 1984 [NL] Netherlands ..... 8403270

[51] Int. Cl.[4] ..... G05D 11/00

[52] U.S. Cl. ..... 137/565; 137/101.31; 68/207; 141/82; 222/54; 417/379

[58] Field of Search ..... 68/207; 137/565, 111, 137/101.31; 222/54; 417/379; 141/1, 82, 192

[56] References Cited

U.S. PATENT DOCUMENTS

| | | | |
|---|---|---|---|
| 2,433,493 | 12/1947 | Turner | 60/25 |
| 2,867,224 | 1/1959 | Martiniak et al. | 134/58 |
| 2,867,974 | 1/1959 | Wenander | 417/379 |
| 2,918,219 | 12/1959 | MacCracken | 417/379 |
| 2,948,436 | 8/1960 | Federighi et al. | 222/54 |
| 3,074,596 | 1/1963 | Marchi | 222/1 |
| 3,399,877 | 9/1968 | Birjukova | 141/82 |
| 4,390,325 | 6/1983 | Elo et al. | 417/379 |

FOREIGN PATENT DOCUMENTS

| | | | |
|---|---|---|---|
| 678027 | 1/1964 | Canada | 222/54 |
| 70825 | 7/1892 | Fed. Rep. of Germany . | |
| 859743 | 12/1952 | Fed. Rep. of Germany . | |
| 669123 | 11/1929 | France . | |
| 2357762 | 7/1976 | France | 417/379 |
| 877143 | 10/1981 | U.S.S.R. | 417/379 |

*Primary Examiner*—A. Michael Chambers

*Attorney, Agent, or Firm*—Milton L. Honig; James J. Farrell

[57] ABSTRACT

The present invention pertains to a thermal pumping system based upon the action of a temperature-sensitive evaporating-condensing expansion liquid for dosing liquid products from a supply container into a washing machine comprising a discharge line having an aeration point above the maximal liquid level of the supply container. The invention provides a fully automatic temperature-triggered pumping system which is self-priming.

7 Claims, 3 Drawing Figures

THERMAL PUMPING SYSTEM FOR LIQUID PRODUCTS

The present invention relates to a thermal pumping system for dosing liquid products, and particularly, but not exclusively, to such a system suitable for dosing liquid detergent products during automatic washing processes.

Thermal pumps are known in the art and are disclosed in e.g. the German Patent No. 859 743. Such pumps comprise a dosing chamber divided into two complementary compartments by an elastic membrane, one compartment being a pumping space and connected to which are supply and discharge lines comprising non-return mechanisms, the other compartment comprising a temperature-sensitive evaporating-condensing expansion liquid.

It has been established that product dosing can as a rule take place during the periods of warming up the wash bath or during the delivery of warm water into the wash or rinse chamber of the washing machine. Thus a first object of the present invention is to provide a pumping system as described above which is put into operation at moments of temperature increase during the washing process.

It is a further object to provide a thermal pumping system which is self-priming at first installation or when air has entered the pumping compartment or tubing system during the replacement operation of the liquid-product supply container.

Accordingly, the present invention provides a thermal pumping system which comprises:

(a) a liquid-product supply container;

(b) a dosing chamber divided into two complementary compartments by an elastic membrane, the first compartment being a pumping space and having product inlets and outlets, the second compartment comprising a temperature-sensitive evaporating-condensing expansion liquid;

(c) a product supply line connecting the supply container to the inlet of the first compartment and having a non-return mechanism; and (d) a discharge line connected to the outlet of the first compartment and having a non-return mechanism;

characterized in that the discharge line has an aeration point above the maximal liquid level of the liquid-product supply container.

The construction should be such that, below the temperature at which the expansion liquid passes into the gas phase, the volume of the second compartment is a small fraction of the volume of the whole dosing chamber, while at higher temperature after transition of the expansion liquid into the gas phase the second compartment has been expanded to a volume which is almost equal to the volume of the whole dosing chamber. As a result of the complementary relationship between the first and second compartment, the effect of a diaphragm pump is thus accomplished at suitable temperatures.

Generally it is desirable that the passing of the expansion liquid into the gas phase takes place in the temperature range between 50° and 75° C., particularly between 60° and 70° C. Preferred expansion liquids are methanol and 2-methyl pentane.

An essential feature of the self-priming system of the present invention is the discharge line having an aeration point above the maximal liquid level of the liquid-product supply container.

To this purpose, a portion of the discharge line extends above the maximal liquid level in the supply container, the discharge line being aerated at a point along this portion. Aeration can be established by any suitable means, such as e.g. an aerating branch-off in the discharge line, or by having the downward portion of the discharge line simply ending at a suitably high level. Preferably, aeration is established by an air gap interruption in the downward portion of the discharge line, at least part of the air gap being above the maximal liquid level of the supply container.

The non-return mechanism in the discharge line is positioned in the portion of the discharge line before the aeration point. Preferably, the non-return mechanism is positioned immediately before the aeration point. As the discharge force is relatively small, it is preferred to use a non-spring-loaded type of non-return valve.

In a further aspect, the present invention provides an automatic washing machine in which a thermal pumping system of the above type is incorporated. The thermal pumping system should be placed in the washing machine in such a way that temperature increases of the washing bath coincide with or lead to an increase in the temperature of the dosing chamber. To this end the dosing chamber can be accommodated in the washing bath itself as well as in the immediate vicinity of, preferably under, a spray nozzle or spray line.

Thus the present invention provides a thermal pumping system of extremely simple construction which is capable of dosing a fixed charge of liquid product in every washing cycle where the temperature is raised above a certain level, without any manual or electric control.

The thermal pumping system in accordance with the invention also exhibits a reliable and convenient self-priming behaviour.

It will be clear that if several liquid products have to be dosed, a corresponding number of thermal pumping systems can be incorporated in the washing machine with the further possibility of including in the different thermal pumping systems expansion liquids having different boiling points so that a thermally differentiated dosing behaviour results.

The dosing chamber should be manufactured from materials which are on the one hand resistant to the chemical attack of the liquids in the expansion and pumping compartments, while on the other hand a good thermal conductivity of at least the top wall of the dosing chamber is a necessity.

The invention will now be explained with reference to the accompanying drawing in which.

Figure 1:
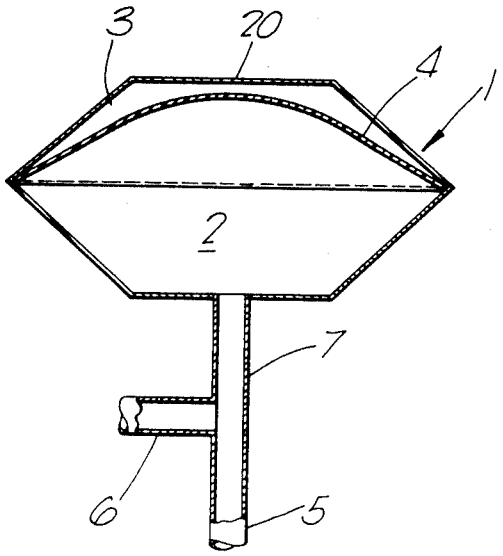
FIG. 1 shows schematically a dosing chamber in accordance with the present invention, the expansion liquid being in condensed state.

The thermal pumping system comprises a dosing chamber (1) which is divided into complementary compartments (2) and (3) by way of an elastic membrane (4). The first compartment (2) has an inlet (5) and an outlet (6), in this embodiment having a joint entry (7) into compartment (2).

Figure 3:
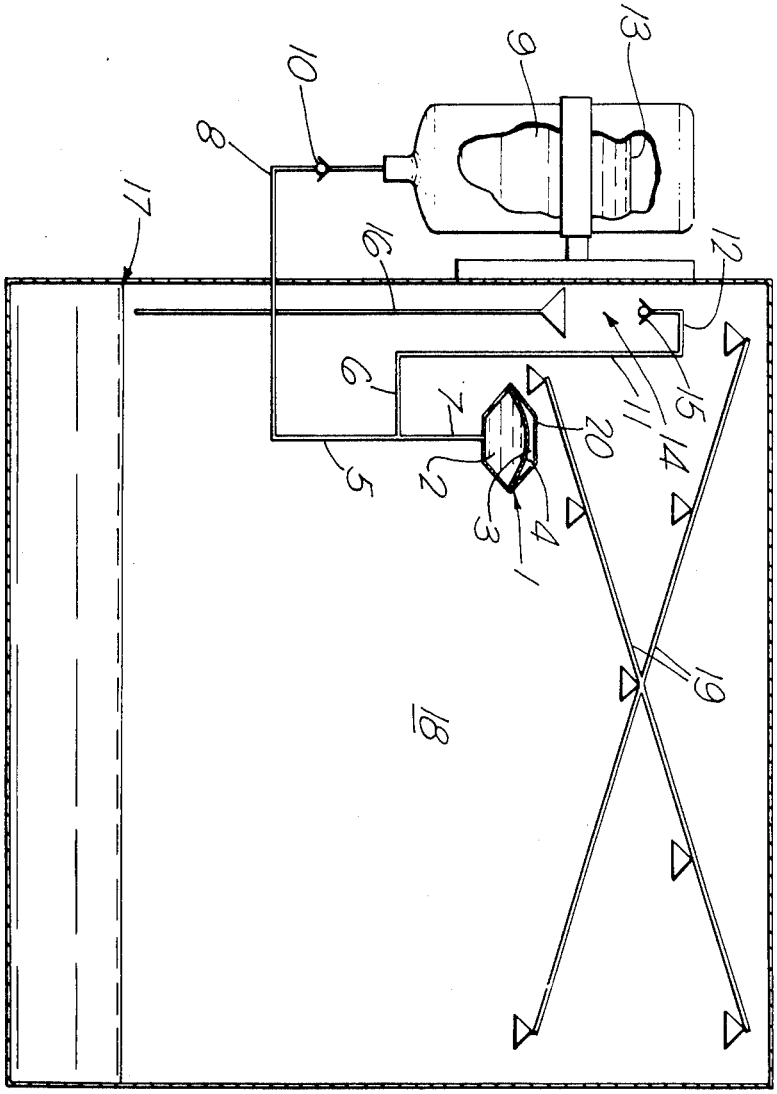
FIG. 3 shows a washing machine comprising a thermal pumping system in accordance with the present invention.

A product supply line (8) connects product supply container (9) to inlet (5) and comprises a non-return valve (10) blocking return flow to container (9). A discharge line (11) is connected to outlet (6), a portion (12) of line (11) extending above the maximal liquid level (13) of supply container (9). Discharge line (11) is interrupted by an air gap (14) immediately before which a non-return valve (15) ensures that no air enters discharge line (11) in return-flow direction. At the downward end of the air gap (14) discharged liquid product is caught in a funnel portion (16) of the discharge line (11) which ends immediately above the wash bath level (17) in the washing machine (18), as schematically drawn in FIG. 3.

The second compartment (3) is substantially completely filled with a temperature-sensitive evaporating-condensing expansion liquid which, in view of the temperatures involved in washing processes, preferably is selected to be methanol having a boiling point of about 65° C. At temperatures below 65° C., where methanol is in its condensed state, the second compartment (3) occupies a relatively small fraction of dosing chamber (1), while the first compartment (2), now having its maximal volume, is filled with liquid product from the supply container (9).

Figure 2:
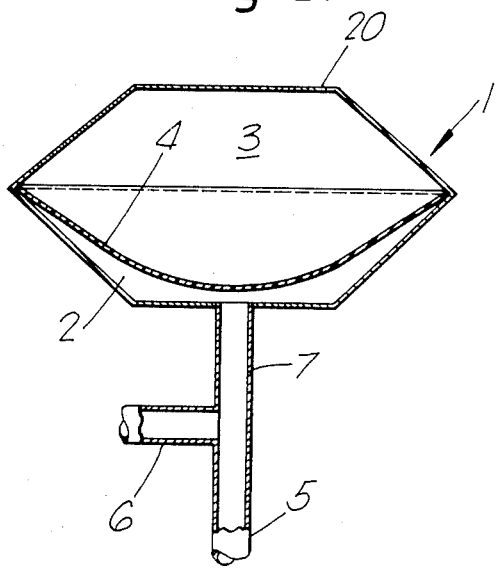
FIG. 2 shows the dosing chamber of FIG. 1, the expansion liquid being in evaporated state.

On increase of the temperature to above 65° C., due to the spraying of e.g. hot rinse water, the liquid methanol will evaporate and expand to a volume of compartment (3) as indicated in FIG. 2.

Owing to this expansion, membrane (4) pushes liquid product out of the first compartment (2) through discharge line (11), the proper flow direction being determined by the combined action of the non-return valves (10) and (15). The amount of liquid product which is accordingly discharged is equal to the difference in the volumes of compartment (2) corresponding to the evaporated and condensed states of the methanol. When the temperature drops again below the condensation point of methanol, the methanol in compartment (3) will pass into the liquid state and membrane (4) will return to its position as indicated in FIG. 1, thereby sucking into compartment (2) a new dose of liquid product, again the combined action of the non-return valves determining the proper flow direction.

To achieve adequate transfer of heat, the dosing chamber (1) is disposed directly under spraying lines (19). For the same purpose, in particular the top wall (20) of dosing chamber (1) is manufactured from materials which have a high thermal conductivity.

Since it is not necessary for the pumping action that the first compartment (2) comprises liquid product, at installation the pumping system is easily primed by subjecting the system to one or more temperature cycles. Accordingly, a fully self-priming system is provided.

We claim:

1. An automatic washing machine comprising a wash chamber, one or more spray lines and a thermal pumping system, said thermal pumping system comprising:
   (a) a liquid-product supply container;
   (b) a dosing chamber divided into two complementary compartments by an elastic membrane, the first compartment being a pumping space filled with said liquid-product and having product inlets and outlets, the second compartment filled with a temperature-sensitive evaporating-condensing expansion liquid;
   (c) a product supply line connecting the supply container to the inlet of the first compartment and having a non-return mechanism; and
   (d) a product discharge line connected to the outlet of the first compartment and having a non-return mechanism, said discharge line having an aeration point above the maximal liquid level of the liquid-product supply container, said discharge line having an opening above said dosing chamber for discharging said liquid-product downwardly in a direction toward said dosing chamber;

and wherein said one or more spraying lines are located above said dosing chamber, said second compartment of the dosing chamer being heated by water sprayed from said spraying lines, but said liquid-product supply container not being heated by said water.

2. System according to claim 1, in which the discharge line has an air gap interruption at the aeration point.

3. System according to claim 1, in which the non-return mechanism in the discharge line is positioned immediatley before the aeration point.

4. System according to claim 1, in which the expansion liquid has a boiling point in the temperature range between 50° and 75° C.

5. System according to claim 1, in which the expansion liquid is methanol.

6. An automatic washing machine according to claim 1 wherein discharged liquid-product from the discharge opening is caught in a funnel portion of the discharge line which ends immediately above a wash bath level in the washing machine.

7. An automatic washing machine according to claim 1 wherein said second compartment filled with the temperature-sensitive expansion liquid is positioned above said first compartment filled with the liquid-product.

* * * * *